US007436362B2

(12) United States Patent
Noro

(10) Patent No.: US 7,436,362 B2
(45) Date of Patent: Oct. 14, 2008

(54) ANTENNA DEVICE

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/616,543

(22) Filed: Dec. 27, 2006

(65) Prior Publication Data

US 2007/0171138 A1 Jul. 26, 2007

(30) Foreign Application Priority Data

Jan. 24, 2006 (JP) ..... P2006-015037

(51) Int. Cl.
*H01Q 1/24* (2006.01)

(52) U.S. Cl. ..... 343/700 MS; 343/713

(58) Field of Classification Search ..... 343/700 MS, 343/713, 704, 702
See application file for complete search history.

(56) References Cited

U.S. PATENT DOCUMENTS 5,625,365 A * 4/1997 Tom et al. ..... 343/700 MS
5,892,481 A * 4/1999 Andersson ..... 343/700 MS
6,867,746 B2 * 3/2005 Mendolia et al. ..... 343/841
6,879,294 B2 * 4/2005 Yuanzhu ..... 343/725
6,888,503 B2 * 5/2005 Shikata ..... 343/700 MS

FOREIGN PATENT DOCUMENTS

JP 2003-309411 10/2003

* cited by examiner

*Primary Examiner*—Tho G Phan
(74) *Attorney, Agent, or Firm*—Whitham Curtis Christofferson & Cook, PC

(57) ABSTRACT

A first antenna portion has a first board having a first face and a second face opposite to the first face, a first antenna element mounted on the first face, and a first electronic circuit mounted on the second face. A second antenna portion has a second board having a third face and a fourth face opposite to the third face, a second antenna element mounted on the third face, and a second electronic circuit mounted on the fourth face. A first conductive wall is provided on the base portion, defining a first shielding space in which the first electronic circuit is accommodated. A second conductive wall provided on the base portion, defining a second shielding space in which the second electronic circuit is accommodated.

7 Claims, 2 Drawing Sheets

ANTENNA DEVICE

The disclosure of Japanese Patent Application No. 2006-015037 filed Jan. 24, 2006 including specification, drawings and claims is incorporated herein by reference in its entirety.

BACKGROUND

The present invention relates to an antenna device. More particularly, the present invention relates to a compound antenna device on which a plurality of antennas is mounted.

Various types of antennas are mounted on a vehicle. Examples of the antennas are: an antenna used for GPS (Global Positioning System); an antenna used for ETC (Electronic Toll Collection System); an antenna used for VICS (Vehicle Information Communication System); and an antenna for telephone use.

GPS (Global Positioning System) is a satellite positioning system using artificial satellites. In GPS, electric waves (GPS signals), which are sent from four (4) artificial satellites in twenty-four (24) artificial satellites geostationary, i.e., rotating with the earth, are received. According to the received electric waves, a positional relation between a moving body and the artificial satellites and an error of time are measured. According to the principle of trigonometric survey, a position and altitude of the moving body on a map can be highly accurate.

GPS is recently used for a car navigation system which detects a position of an automobile running. The car navigation system includes: an antenna used for GPS to receive GPS signals; a processor for processing GPS signals received by the antenna for GPS and for detecting a present position of the vehicle; and a display for displaying a position, which has been detected by this processor, on a map.

On the other hand, ETC (Electric Toll Collection) is a system developed as a measure for relieving traffic jam at a toll-booth in which a toll of a toll road such as a highway is collected. That is, ETC is a system for automatically paying the toll by utilizing wireless correspondence at the toll booth of the highway. ETC is operated as follows. Between a road side antenna provided in a gate arranged in the toll booth and an antenna for ETC of a vehicle, which passes through the toll booth, on which a corresponding device for ETC is mounted, bilateral communication is performed. In this way, the toll booth obtains a piece of necessary vehicle information of the vehicle passing through the toll gate. Therefore, the toll of the highway can be paid without stopping the vehicle.

The antenna for GPS and the antenna for ETC are jointly provided in a related-art compound antenna.

In a first related-art compound antenna device, a plurality of antenna elements are respectively mounted on corresponding boards and low noise amplifying circuit parts (LNA) are attached onto a lower side of each board. This low noise amplifying circuit parts (LNA) are covered with a shielding case.

For example, as shown in FIG. 4, a compound antenna 100 (refer to Japanese Patent Publication No. 2003-309411) is a small antenna unit mounted on a vehicle which is composed as follows. On an attaching plate, a patch antenna 103 for receiving circularly polarized waves sent from GPS satellite and a rod-shaped antenna 104 for sending and receiving linearly polarized waves used for mobile phone are arranged together and both the antennas are accommodated in a common radome 112. Electricity is fed to the patch antenna 103 through a cable 105 and a connector 113. The patch antenna 103 is composed as follows. A feeding patch 107, which is an emission element of a micro-strip structure, is provided on an upper face of a dielectric board 108. This dielectric board 108 is mounted on a circuit board 109 Low noise amplifying circuit parts (LNA) 116 such as an amplifier and a band-pass filter covered with a shield case 115 are mounted on a lower side of the circuit board 109.

In Japanese Patent Publication No. 2003-309411, the compound antenna is provided with a patch antenna and a rod-shaped antenna. It is sufficient to estimate the first related-art compound antenna device described above to have a structure in which a plurality of patch antennas are provided and each patch antenna is mounted on a board.

However, in the first related-art compound antenna device, each shielding case is respectively attached to an antenna element. Therefore, problems may be encountered when the size of the device is reduced and the number of parts is decreased.

In order to solve the above problems, in the second related-art compound antenna device, the low noise amplifying circuit parts (LNA) attached onto the lower side of each board are covered with one shielding case. Accordingly, the number of parts can be decreased and further the size of the device can be reduced.

However, according to the second related-art compound antenna device described above, the following problems may be encountered. Onto the lower side of the board on which each antenna element is respectively mounted, low noise amplifying circuit parts (LNA) are attached and the shielding cover is attached so that it can cover the entire LNA. Therefore, no shielding member is provided between one antenna (for example, an antenna for GSP) and the other antenna (for example, an antenna for SDARS (satellite radio)). Accordingly, earth interference with each antenna and LNA is caused.

SUMMARY

It is therefore an object of the invention to provide a compact antenna device capable of reducing earth interference with each antenna and LNA.

In order to achieve the above described object, according to the invention, there is provided an antenna device comprising:

a first antenna portion having:

a first board having a first face and a second face opposite to the first face;

a first antenna element mounted on the first face; and a first electronic circuit mounted on the second face;

a second antenna portion having:

a second board having a third face and a fourth face opposite to the third face;

a second antenna element mounted on the third face; and a second electronic circuit mounted on the fourth face;

a conductive base portion; and a first conductive wall provided on the base portion, defining a first shielding space in which the first electronic circuit is accommodated; and a second conductive wall provided on the base portion, defining a second shielding space in which the second electronic circuit is accommodated.

The first conductive wall may be monolithically formed on the base portion.

The second conductive wall may be monolithically formed on the base portion.

The base portion may be formed with a through hole so that cables led out from the first board and the second board is inserted into the through hole.

The second face of the first board may be fixed to the first conductive wall; and The fourth face of the second board may be fixed to the second conductive wall.

The antenna device may further comprise:

a case engaged with the base portion and accommodating the antenna portion.

The antenna device may further comprise:

a pad covering an outer periphery of the base portion and attached to the case.

The base portion may be comprised of die casting material.

A part of the first conductive wall may be monolithically formed with a part of the second conductive wall.

With this configuration, one base portion comprised of die-casting material has a function of a shield cover and a function of a bottom case. Accordingly, the structure can be made simple. Further, the number of parts can be decreased and the manufacturing cost can be reduced.

With this configuration, the first and second conductive walls formed monolithically on the conductive base portion which is comprised of die-casting material, shuts off the first electronic circuit (for example, LNA) corresponding to the first antenna element and the second electronic circuit (for example, filter circuit) corresponding to the second antenna element from each other and further separates the first antenna element earth and the second antenna element earth from each other. Therefore, it is possible to reduce earth interference with the first and the second antenna elements and with the electronic circuits (LNA, filter circuit and others) corresponding to the first and the second antenna elements.

According to the invention, there is also provided an antenna device An antenna device comprising:

a first antenna portion having:

a first board having a first face and a second face opposite to the first face;

a first antenna element mounted on the first face; and a first electronic circuit mounted on the second face;

a second antenna portion having:

a second board having a third face and a fourth face opposite to the third face;

a second antenna element mounted on the third face; and a second electronic circuit mounted on the fourth face;

a conductive base portion; and a first conductive wall provided on the base portion, defining a first shielding space in which the first electronic circuit is accommodated; and a second conductive wall provided on the base portion, defining a second shielding space in which the second electronic circuit is accommodated, wherein:

a part of the first conductive wall is monolithically formed with a part of the second conductive wall so as to electromagnetically separate the first shielding space from the second shielding space.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, an embodiment of an antenna device according to the invention will be discussed with reference to the accompanying drawings.

Figure 1:
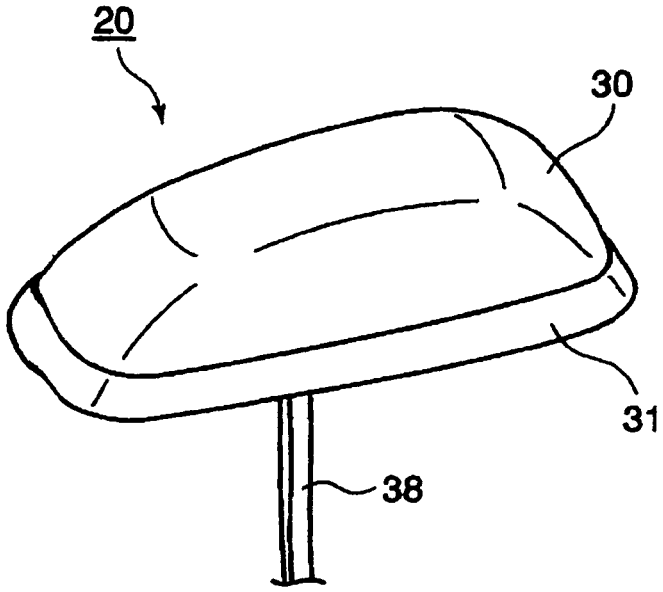
FIG. 1 is a perspective view showing appearance of a compound antenna device to which a top case is attached according to an embodiment of the invention.
Figure 2:
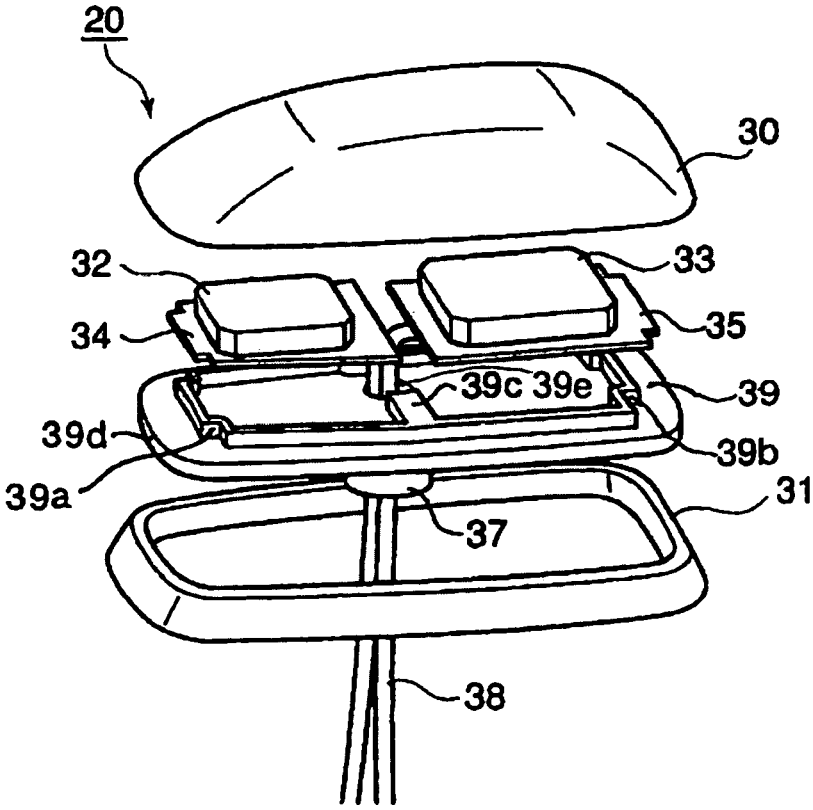
FIG. 2 is an exploded perspective view showing the compound antenna device from which a top case is detached according to the embodiment.

As shown in FIGS. 1 and 2, the compound antenna device 20 includes: a top case 30; a board 34 on which the first antenna element 32 is mounted; a board 35 on which the second antenna element 33 is mounted; a base 39 for shielding a low noise amplifying circuit (not shown), which will be referred to as LNA hereinafter, and for shielding a filter circuit (not shown), which are respectively mounted on reverse sides of the boards 34, 35, wherein the base 39 functions as a base cover; and a base pad 31 for covering a side of the base 39. The base pad 31 has an opening portion, the size of which is substantially the same as the outer size of the base 39.

The first and the second antenna element 32, 33 are accommodated in the top case 30 and on the base 39, the side of which is covered with the base pad 31. On the boards 34, 35, the first and the second antenna element 32, 33 are respectively mounted. In the example shown in the drawing, the first antenna element 32 is an antenna for GPS and the second antenna element 33 is an antenna for SDARS (satellite radio).

On a reverse side (not shown) of the board 34 on which the first antenna element 32 is mounted, LNA (not shown) is mounted. On a reverse side (not shown) of the board 35 on which the second antenna element 33 is mounted, a filter circuit (not shown) is mounted. In the example shown in the drawing, the first and the second antenna element 32, 33 are respectively composed of a patch antenna.

The base 39 is attached to the boards 34, 35 by means of screwing. Further, the base 39 is engaged in an opening portion of the base pad 31 and attached to the top case 30.

Figure 3:
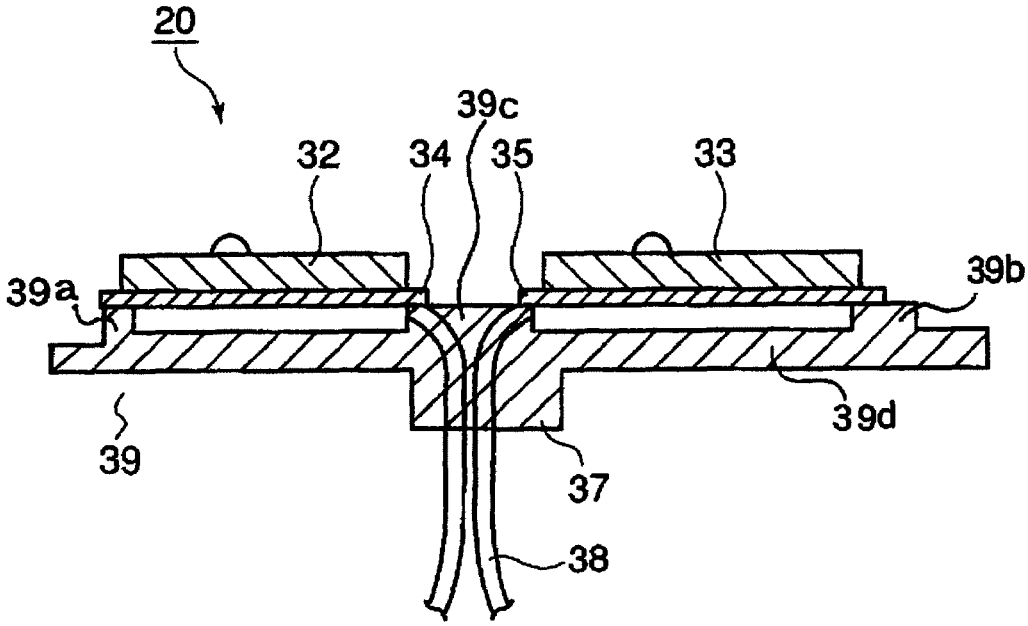
FIG. 3 is a longitudinal section view of the compound antenna device according to the embodiment of the invention.
Figure 4:
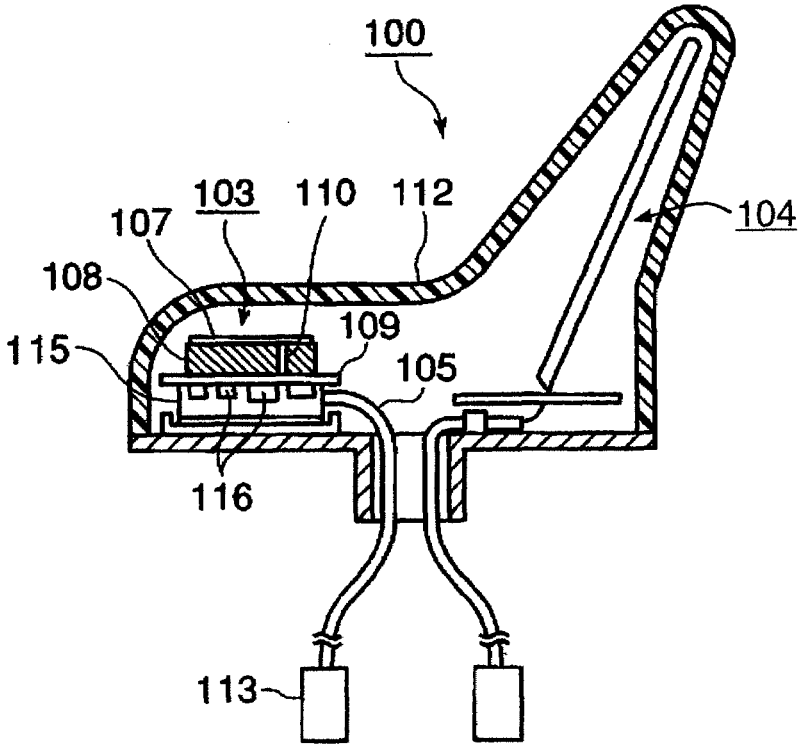
FIG. 4 is a longitudinal sectional view showing a structure of a related-art compound antenna device.

As shown in FIGS. 2 and 3, the base 39 includes: a base portion 39*d*; and a shielding portion, which is provided on an upper face of the base portion 39*d*, for shielding LNA an the filter circuit respectively mounted on the reverse sides of the boards 34, 35. In the shielding portion, shielding walls 39*a*, 39*b*, 39*c* are continuously formed. The entire shielding portion is formed into a substantial C-shape. As shown in FIG. 3, the shielding wall 39*c* is formed being located between the first and the second antenna element 32, 33. Referring to FIG. 2, through On base 39*a* through-hole 39*e* is formed, and through which an output cable 38 that is led out from each board (34, 35) is inserted. FIG. 3 shows the cable 39 inserted through the through-hole 39*e* (cross-sectional edge of through-hole 39 not visible in FIG. 3).

Shielding walls corresponding to the first antenna element 32 are the shielding walls 39*a*, 39*c*. Shielding walls corresponding to the second antenna element 33 are the shielding walls 39*b*, 39*c*.

In the above structure, the first antenna element 32 and LAN corresponding to the first antenna element 32, and the second antenna element 33 and the filter circuit corresponding to the second antenna element 33 are respectively shut off from each other by the shielding wall 39*c* arranged on the central portion side. That is, the shielding wall 39*c* on the central portion side, which is one of the shielding walls 39*a*, 39*b*, 39*c*, shuts off LNA corresponding to the first antenna element 32 and the filter circuit corresponding to the second antenna element 33 from each other. Further, the shielding wall 39*c* on the central portion side shuts off LNA corresponding to the first antenna element 32 and the filter circuit corresponding to the second antenna element 33 from each other. Furthermore, the shielding wall 39*c* on the central portion side separates the earth of the first antenna element 32 and the earth of the second antenna element 33 from each other. Therefore, it is possible to reduce earth interference with respect to the first 32 and the second antenna 33. Further, it is possible to reduce earth interference with respect to LNA and the filter circuit corresponding to the first 32 and the second antenna element 33.

In the related-art described above, it is necessary to provide the bottom case having no opening portion corresponding to the top case. However, in the embodiment of the invention, the base 39 has both the function of shielding and the function of a bottom case. That is, the base 39 has both the function of reducing the above earth interference and the function of the bottom case. In this connection, this base 39 is molded out of die-casting material such as zinc or aluminum.

A bolpost portion 37 is formed on a lower side of the base 39. This bolpost portion 37 has a function of bundling up the output cables 38 led out from the boards 34, 35.

The embodiment of the present invention is explained above. However, of course, the present invention is not limited to the above specific embodiment.

What is claimed is:

1. An antenna device comprising:

a first antenna portion having:

a first board having a first face and a second face opposite to the first face;

a first antenna element mounted on the first face; and a first electronic circuit mounted on the second face;

a second antenna portion having:

a second board having a third face and a fourth face opposite to the third face;

a second antenna element mounted on the third face; and a second electronic circuit mounted on the fourth face;

a conductive base portion having a through hole;

a first conductive wall provided on the base portion, defining a first shielding space in which the first electronic circuit is accommodated; and a second conductive wall provided on the base portion, defining a second shielding space in which the second electronic circuit is accommodated, wherein:

the through hole of the base portion is arranged to provide a clearance for cables led out from the first board and the second board and inserted through the through hole;

a part of the first conductive wall is monolithically formed with a part of the second conductive wall; and the through hole is located between the first shielding space and the second shielding space so that the first shielding space is surrounded by the first conductive wall and the through hole and the second shielding space is surrounded by the second conductive wall and the through hole.

2. The antenna device as set forth in claim 1, wherein:

the first conductive wall is monolithically formed on the base portion; and the second conductive wall is monolithically formed on the base portion.

3. The antenna device as set forth in claim 1, wherein:

the second face of the first board is fixed to the first conductive wall; and the fourth face of the second board is fixed to the second conductive wall.

4. The antenna device as set forth in claim 1, further comprising:

a case engaged with the base portion and accommodating the base antenna portion.

5. The antenna device as set forth in claim 1, further comprising:

a pad covering an outer periphery of the base portion and attached to the case.

6. The antenna device as set forth on claim 1, wherein the base portion is comprised of die casting material.

7. The antenna device as set forth in claim 1, wherein:

the monolithic-formed part of the first conductive wall and the second conductive wall separates the first shielding space from the second shielding space.

* * * * *